United States Patent [19]

Tominaga et al.

[11] Patent Number: 4,562,808

[45] Date of Patent: Jan. 7, 1986

[54] ENGINE IDLING SPEED CONTROL

[75] Inventors: Kazunori Tominaga; Yoshitaka Tanikawa, both of Hiroshima, Japan

[73] Assignee: Mazda Motor Corporation, Hiroshima, Japan

[21] Appl. No.: 654,875

[22] Filed: Sep. 27, 1984

[30] Foreign Application Priority Data

Sep. 27, 1983 [JP] Japan ..... 58-181597

[51] Int. Cl.[4] ..... F02D 11/10

[52] U.S. Cl. ..... 123/339; 123/340; 290/40 R

[58] Field of Search ..... 123/339, 585, 340; 290/40 R, 40 A, 40 B, 40 C

[56] References Cited

U.S. PATENT DOCUMENTS

| | | | |
|---|---|---|---|
| 4,184,083 | 1/1980 | Takeuchi | 290/40 C |
| 4,203,395 | 5/1980 | Cromas | 123/339 |
| 4,289,100 | 9/1981 | Kinugawa | 123/339 |
| 4,345,557 | 8/1982 | Ikeura | 123/339 |
| 4,354,466 | 10/1982 | Dudley | 123/339 |
| 4,375,208 | 3/1983 | Furuhashi | 123/339 |
| 4,385,603 | 5/1983 | Bonse | 123/339 |
| 4,406,261 | 9/1983 | Ikeura | 123/339 |
| 4,418,665 | 12/1983 | Nagase | 123/339 |
| 4,425,887 | 1/1984 | Knapp | 123/339 |
| 4,438,744 | 3/1984 | Hasegawa | 123/339 |
| 4,467,761 | 8/1984 | Hasegawa | 123/339 |

FOREIGN PATENT DOCUMENTS

| | | | |
|---|---|---|---|
| 54-113725 | 9/1979 | Japan | 123/339 |

*Primary Examiner*—Ronald B. Cox

*Attorney, Agent, or Firm*—Fleit, Jacobson, Cohn & Price

[57] ABSTRACT

An internal combustion engine has an intake system provided with a valve for controlling the intake air flow in an idling operation. There is provided a control system including an engine speed detector and a control circuit which compares the engine speed signal from the engine speed detector with a reference value corresponding to a desired idling speed to produce a feedback signal for adjusting the valve. There is also provided an external load detector for producing a modifying signal when an external load is applied to the engine in the idling operation. The control system functions to interrupt the feedback control under the feedback signal for a predetermined time when the external load is applied or removed so as to stabilize the engine speed in a transient period.

18 Claims, 5 Drawing Figures

ENGINE IDLING SPEED CONTROL

BACKGROUND OF THE INVENTION

1. Field of the Invention

The present invention relates to an engine control system and more particularly to an idling speed control system for internal combustion engines. More specifically, the present invention pertains to an idling speed control system of a feedback type wherein the actual engine speed is compared with a reference speed to obtain a difference signal which is used to control the engine intake air so that the actual engine speed approaches the reference speed.

2. Description of Prior Art

In recent automobile engines, there is provided an idling speed control system in which the actual engine speed is compared with a reference speed to control the engine intake air so that the actual engine speed approaches the reference speed. In this type of control system, when the engine is suddenly subjected in an idling operation to a load, such as a motor for a car cooler, the engine speed is momentarily decreased and there may be a danger of engine stop. In order to eliminate the problem, there is proposed by a Japanese patent application No. 53-20902 filed on Feb. 27, 1978 and disclosed for public inspection on Sept. 5, 1979 under the disclosure number 54-113725 to add the signal representing the difference between the actual and reference speeds with a compensating signal which corresponds to the additional load. The proposal is considered to improve to some extent responsive characteristics to load changes of an engine under an idling operation, however, there still is a transient period wherein the engine speed is unstable for a certain time period after a change in load. Describing in more detail, even when the intake air is adjusted by the compensating signal, there is a certain time delay before the engine speed is actually changed, so that there will be a certain amount of decrease in the engine speed and there will therefore be produced a difference signal which will be added with the compensating signal. These signals function to adjust the intake air in the same way so that there is a high possibility of over-control. If such over-control is effected when a load is externally added to the idling engine, the engine will overrun and the engine speed will be abruptly increased. When a load is removed from the engine, such over-control will produce an abrupt decrease in the engine speed and may sometimes cause an engine stop.

OBJECTS OF THE INVENTION

It is therefore an object of the present invention to provide an engine idling speed control system in which a stable engine speed is maintained even under a change in engine load in an idling operation.

Another object of the present invention is to provide a feedback type engine idling speed control system which can provide a stable idling speed even in a transient period in which an external load to the engine is applied or removed.

According to the present invention, the above and other objects can be accomplished by an engine idling speed control system including engine speed detecting means for detecting an engine speed and producing an actual engine speed signal, load detecting means for detecting external load applied to the engine, engine intake air adjusting valve means for adjusting intake air flow to the engine, means for comparing the actual engine speed signal with a reference signal to produce a feedback control signal, actuating means for actuating said intake air adjusting valve means in accordance with said feedback control signal so that the intake air flow is adjusted to make the actual engine speed approach to a desired speed corresponding to the reference signal, signal modifying means responsive to an output of the load detecting means for adding a modifying value to said feedback control signal when the external load is applied to the engine, feedback interrupting means for interrupting feedback control based on said feedback control signal for a predetermined time when there is any change in the external load applied to the engine. The actuating means may be of a type in which opening of the valve means is determined by the value of the signal applied to the actuating means and the feedback interrupting means may then be means for maintaining the control signal constant for the predetermined time.

According to the present invention, the feedback control based on the control signal is interrupted for a predetermined time when an external load is applied or when the external load is removed so that it is possible to maintain the engine idling speed stable in a transient period wherein the load on the engine changes. The external load may be a motor for a car cooler or any other electric load, or a load for driving a torque converter of an automatic transmission.

BRIEF DESCRIPTION OF THE DRAWINGS

The drawings show an engine idling speed control system in accordance with one embodiment of the present invention. In the drawings.

DESCRIPTIONS OF THE PREFERRED EMBODIMENT

Figure 1:
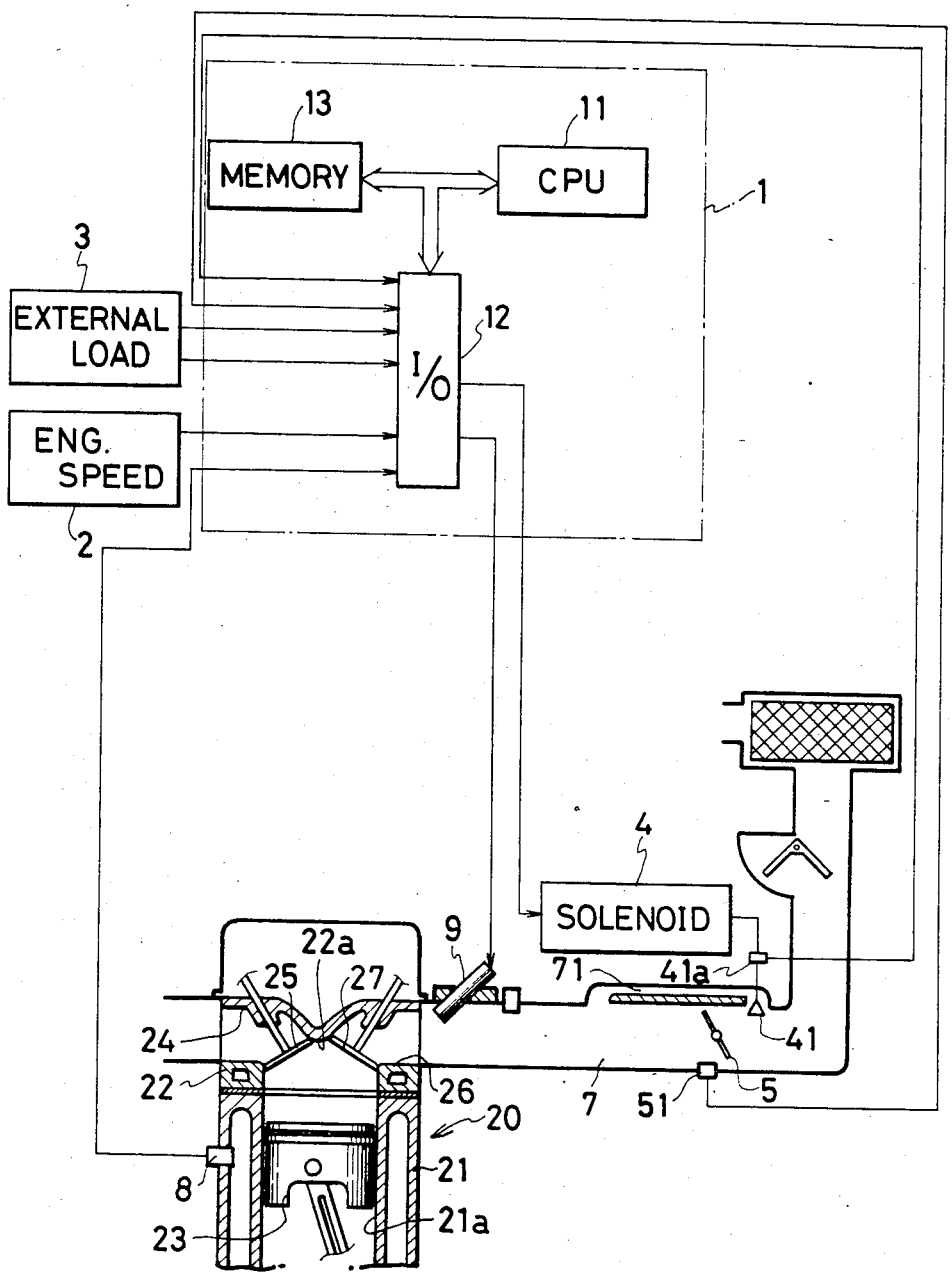
FIG. 1 is a diagrammatical illustration of the system.

Referring to the drawings, particularly to FIG. 1, there is shown an engine 20 having a cylinder block 21 formed with a cylinder bore 21*a* and a cylinder head 22 secured to the top end of the cylinder block 21. The cylinder head 22 has a recess 22*a* for defining a combustion chamber and a piston 23 is disposed in the cylinder bore 21*a* for reciprocating movement. The cylinder head 22 is formed with an exhaust port 24 provided with an exhaust valve 25. The cylinder head 22 is also formed with an intake port 26 provided with an intake valve 27.

The intake port 26 is connected with an intake passage 7 which is provided with a throttle valve 5. In the vicinity of the intake port 26, the intake passage 7 is provided with a fuel injection valve 9 for discharging a metered amount of fuel to the intake passage 7. The intake passage 7 is further formed with a bypass passage 71 bypassing the throttle valve 5. The bypass passage 71 has an adjusting valve 41 which is controlled by an actuator 4. The actuator 4 may be a duty factor type solenoid of which displacement is determined by the duty factor of energizing pulses applied to the actuator 4. Thus, the opening of the valve 4 is determined by the displacement of the actuator 4 which is determined by the duty factor of the pulses applied to the actuator 4. In an engine idling operation wherein the throttle valve 5 is in the minimum opening position, the intake air flow to the engine 20 is controlled by the valve 41.

In order to control the opening of the valve 41, there is provided a control unit 1 which includes a central power unit 11, an input-output device 12 and a memory 13. The control unit 1 may be constituted by a microprocessor. The input-output device 12 is connected with an engine speed detector 2, a load detector 3 and an engine throttle valve position detector 51. The engine speed detector 2 may be constituted by a toothed wheel made of a magnetic material and rotated in synchronism with the engine crankshaft (not shown) and a magnetic detector which senses that teeth of the wheel have passed by the detector and produces pulses having a frequency proportional to the engine speed. The load detector 3 may be a position detector for a switch for a car cooler or any other electric facility and produce a signal when the switch is closed. In case of an automobile having an automatic transmission, the load detector 3 may be a select valve position sensor which produces a load signal when the transmission is in either one of "D", "2" and "1" positions. The throttle valve position detector 51 may be a switch which is closed when the throttle valve 5 is in the minimum opening position.

The adjusting valve 41 is provided with a valve position detector 41*a* which produces a valve position signal representing the opening of the adjusting valve. The output of the valve position detector 41*a* is connected with the input-output device 12. The engine 20 is provided with a temperature detector 8 which detects the temperature of the engine cooling water. The output of the temperature detector 8 is also connected with the input-output device 12.

Figures 2, 2A:
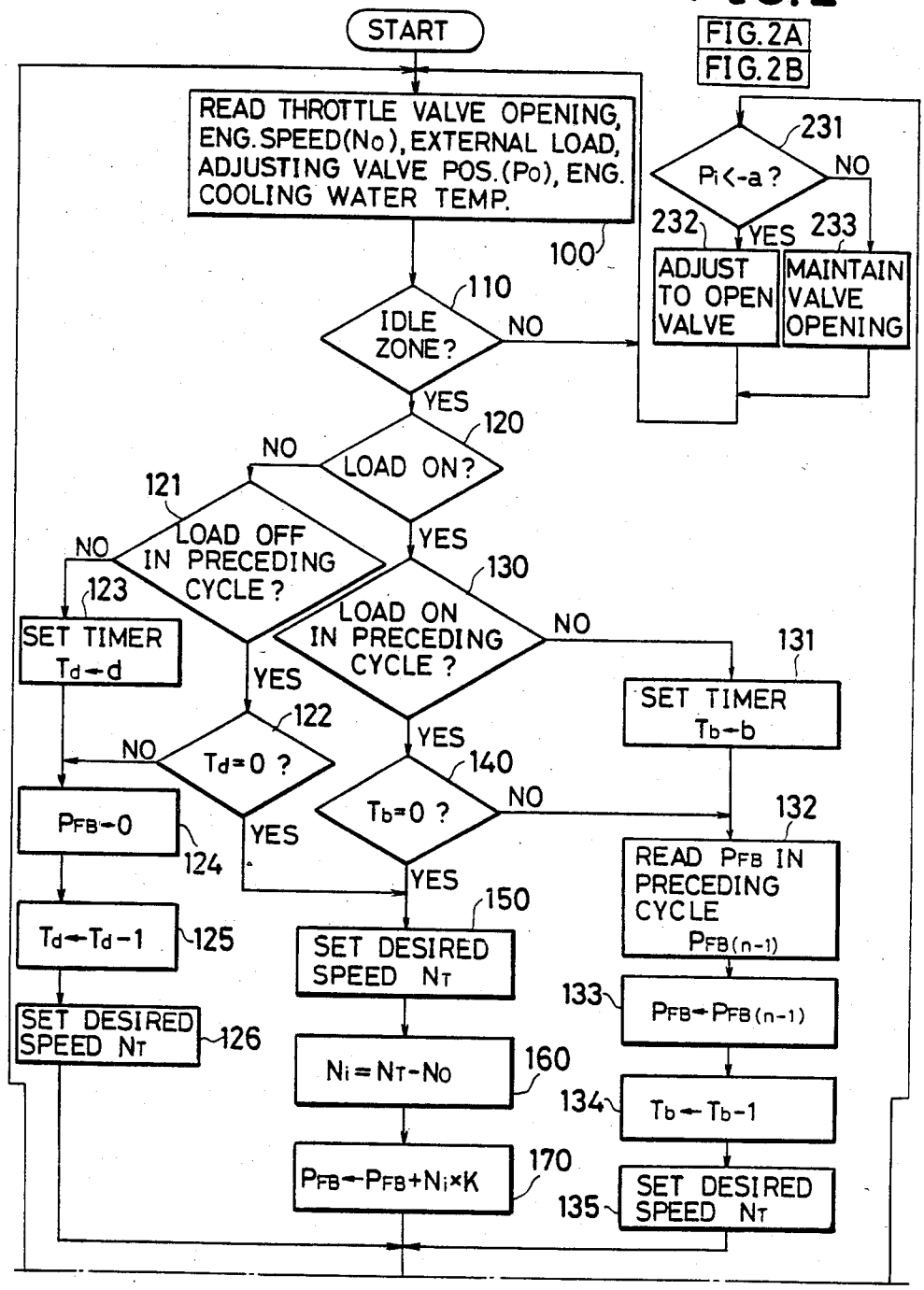
FIGS. 2, 2A and 2B are program flow charts showing the operation of the control unit shown in FIG. 1; and, FIG. 3 is a diagram for determining the temperature modifying factor for determining the basic control factor.
Figure 2B:
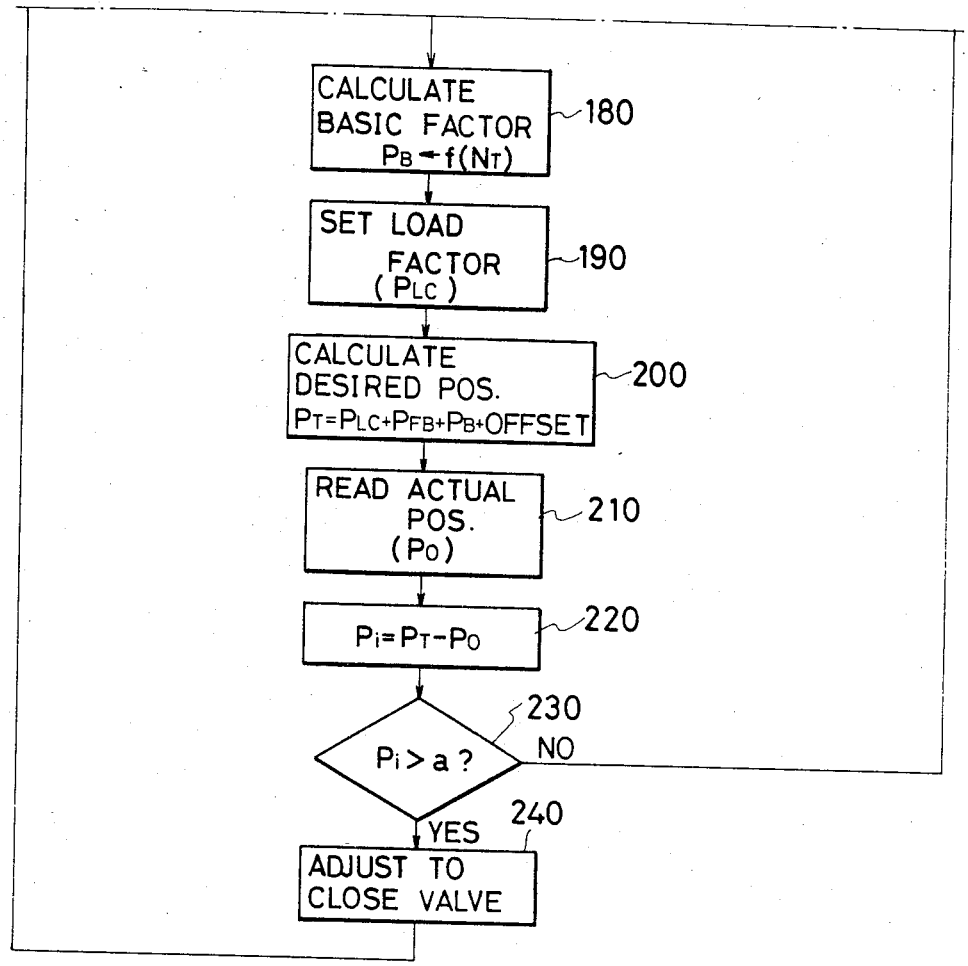

Referring to FIG. 2, there is shown the operation of the control unit 1. In operation, the throttle valve position, the engine speed, the engine load, the adjusting valve position and the engine cooling water temperature are read in step 100 by the signals from the appropriate detectors. In step 110, a judgement is made as to whether the engine is in an idling zone. When the throttle valve position detector 51 indicates that the throttle valve 5 is in the minimum opening position and the speed detector 2 indicates that the engine speed is below a predetermined value, it is judged that the engine is in the idling zone.

Where the judgement is that the engine is not in the idling zone, the step 100 is operated. However, when the judgement is that the engine is in the idling zone, then a next step 120 is carried out. In the step 120, a judgement is made as to whether an external load is applied to the engine. When the result of the judgement is YES, a further judgement is made in step 130 as to whether the load was applied in the preceeding cycle of operation. When the result of the judgement in the step 130 is NO, a timer b is set to Tb in step 131. Then, the control factor $P_{FB(n-1)}$ which has been calculated in the preceeding cycle is read in step 132 and the factor $P_{FB(n-1)}$ is adopted as the control factor $P_{FB}$ in this operating cycle in step 133. Then, the count in the timer is subtracted by one in step 134. Thereafter, a desired engine idling speed $N_T$ under an external load is selected in step 135.

If the judgement in the step 130 is YES, a judgement is made in step 140 as to whether the count Tb in the timer is zero. When the result of judgement is NO, the procedure is progressed to the step 132 and the aforementioned steps 133, 134 and 135 are carried out. When the result of the judgement in the step 140 is YES, then the desired engine idling speed $N_T$ under an external load is selected in step 150 as in the step 135. Then, the selected desired speed $N_T$ is compared in step 160 with the actual engine speed No to obtain a differential speed Ni. Then, a feedback control factor $P_{FB}$ is calculated in step 170 based on the feedback control factor $P_{FB}$ as calculated in the preceeding cycle and the differential speed Ni in accordance with the equation $$P_{FB} \leftarrow P_{FB} + Ni \times k$$

where k is a constant.

Figure 3:
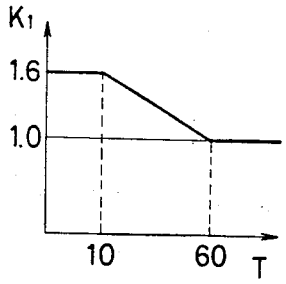

Following to either of the steps 135 and 170, a basic control factor $P_B$ is calculated in step 180 based on the desired engine speed $N_T$ and the engine cooling water temperature T in accordance with the equation $$P_B \leftarrow K_1 \times N_T$$

where $K_1$ is a factor which changes for example as shown in FIG. 3 in accordance with the temperature T. Thereafter, a load compensating factor $P_{LC}$ is read in step 190. The factor $P_{LC}$ may be a constant value which is adopted when an external load is applied to the engine. In a following step 200, a calculation is made to obtain a desired position $P_T$ of the adjusting valve 41 in accordance with the equation $$P_T = P_{LC} + P_{FB} + P_B + OFFSET$$

where OFFSET is a compensating value which is inherent to individual models of the engines.

Then, the actual position Po of the adjusting valve 41 is read in step 210 and compared with the desired position $P_T$ in step 220 in accordance with the equation $$Pi = P_T - Po$$

to obtain a differential position Pi. The differential position Pi is compared in step 230 with a constant value a which determines the allowable limit for deviation of the actual valve position Po from the desired position $P_T$. When the value Pi is greater than the value a, the control unit 1 produces an output pulse which energizes the actuator 4 in a direction of decreasing the opening of the adjusting valve 41 as shown in step 240. When the value Pi is smaller than the value a, the value Pi is compared with a value −a in step 231. If the value Pi is smaller than the value −a, the control unit 1 produces an output pulse in the direction of increasing the opening of the adjusting valve 41 as shown in step 232. If the value Pi is greater than the value −a, the valve opening is maintained as shown in step 233.

When it is judged in the step 120 that any external load is not applied to the engine, a judgement is made in step 121 as to whether there was no load in the preceeding cycle. If the judgement is to indicate that there was no load in the preceeding cycle, a further judgement is made as to whether the count Td in the timer is zero in step 122. When the result of judgement is YES, the procedure is progressed to the step 150.

When the judgement in the step 121 is to indicate that there was an external load in the preceeding cycle, a timer d is set to Td in step 123. Then, the feedback control factor $P_{FB}$ is set to zero in step 124 and the count Td in the timer is subtracted by one in step 125. Thereafter, a desired engine idling speed $N_T$ for no load condition is selected in step 126. The desired idling speed for no load condition is lower than the speed selected in the steps 135 and 160. The procedure is then progressed to the step 180. Where the judgement in the step 122 is NO, the procedure is progressed to the step 124.

It will be understood from the above descriptions, in a transient period wherein a predetermined time period has not passed since an external load to the engine is applied, the value of the feedback control factor $P_{FB}$ in the previous cycle is adopted to control the position of the adjusting valve 41. When the external load is removed, however, the feedback control factor $P_{FB}$ is set to zero even in the transient period. This is because, when the factor $P_{FB}$ is of a negative value in the previous cycle, there may be a danger of engine stop if the value is adopted as it is. In any event, the feedback control is interrupted in the transient period so that it is possible to stabilize the engine idling speed even when an external load is applied or removed.

In the embodiment described above, the engine is provided with an adjusting valve separately from the throttle valve. It should be noted, however, that the adjusting valve and the bypass passage may be omitted and the throttle valve may be controlled.

The invention has thus been shown and described with reference to a specific embodiment, however, it should be noted that the invention is in no way limited to the details of the illustrated arrangements but changes and modifications may be made without departing from the scope of the appended claims.

We claim:

1. An engine idling speed control system including engine speed detecting means for detecting an engine speed and producing an actual engine speed signal, load detecting means for detecting external load applied to the engine, engine intake air adjusting valve means for adjusting intake air flow to the engine, means for comparing the actual engine speed signal with a reference signal produce a feedback control signal, actuating means for actuating said intake air adjusting valve means in accordance with said feedback control signal so that the intake air flow is adjusted to make the actual engine speed approach to a desired speed corresponding to the reference signal, signal modifying means responsive to an output of the load detecting means for adding a modifying value to said feedback control signal when the external load is applied to the engine, feedback interrupting means for interrupting feedback control based on said feedback control signal for a predetermined time when the external load is applied to the engine, means for determining the reference signal in accordance with an engine temperature, and control means for providing a final control value based on a basic control signal corresponding to the reference signal, the feedback control signal and the modifying value.

2. A control system in accordance with claim 1 in which said actuating means is of a type wherein opening of the valve means is determined by a value of signal applied to the actuating means, said feedback interrupting means including means for maintaining the feedback control signal at a predetermined value for the predetermined time.

3. A control system in accordance with claim 1 in which said actuating means is of a type wherein opening of the valve means is determined by a value of signal applied to the actuating means, said feedback interrupting means including means for maintaining the feedback control signal at a first predetermined value when the external load is applied and at a second predetermined value when the external load is removed.

4. A control system in accordance with claim 2 in which said last mentioned means including means for fixing the feedback control signal to a value of the feedback control signal just before the external load is applied.

5. A control system in accordance with claim 2 in which said predetermined value is zero.

6. A control system in accordance with claim 1 in which said feedback interrupting means includes means for maintaining the feedback control signal at a predetermined value for the predetermined time when there is any change in the external load.

7. A control system in accordance with claim 6 in which said predetermined value is determined when the external load is applied as the feedback control signal just before the load is applied and when the external load is removed as a zero value.

8. A control system in accordance with claim 7 in which said adjusting valve means is valve means provided in bypass passage means bypassing engine throttle valve means.

9. A control system in accordance with claim 1 in which said adjusting valve means is provided in bypass passage means bypassing engine throttle valve means.

10. A control system in accordance with claim 1 in which the feedback interrupting means recives the signals from the load detecting means to interrupt the feedback control when the external load is applied to the engine and when the external load is removed from the engine.

11. A control system in accordance with claim 10 in which the reference signal is maintained at a constant value for a predetermined time.

12. A control system in accordance with claim 11 in which the constant value is maintained at zero when the external load is applied and/or when the external load is removed.

13. An engine idling speed control system including engine speed detecting means for detecting an engine speed and producing an actual engine speed signal, load detecting means for detecting external load, for driving an auxiliary equipment such as a cooler, applied to the engine, engine intake air adjusting valve means for adjusting intake air flow to the engine, means for comparing the actual engine speed signal with a reference signal to produce a feedback control signal, actuating means for actuating said intake air adjusting valve means in accordance with said feedback control signal so that the intake air flow is adjusted to make the actual engine speed approach to a desired speed corresponding to the reference signal, signal modifying means responsive to an output of the load detecting means for adding a modifying valve to said feedback control signal when the external electrical load is applied to the engine, idling judgment means for judging whether or not the engine is in an idling zone, and feedback interrupting means for interrupting feedback control based on said feedback control signal when the external electrical load is applied or removed under the idling condition of the engine.

14. A control system in accordance with claim 13 in which said feedback interrupting means includes means for interrupting the feedback control for a predetermined time when an external load is applied to the engine.

15. A control system in accordance with claim 13 in which the feedback interrupting means receives the signals from the load detecting means to interrupt the feedback control when the external load is applied to the engine and when the external load is removed from the engine.

16. A control system in accordance with claim 15 in which the reference signal is maintained at a constant value for a predetermined time.

17. A control system in accordance with claim 16 which further includes means for determining the reference signal in accordance with an engine temperature, and control means for providing a final control value based on a basic control signal corresponding to the reference signal, the feedback control signal and the modifying value.

18. A control system in accordance with claim 13 which further includes means for determining the reference signal in accordance with an engine temperature, and control means for providing a final control valve base on a basic control signal corresponding to the reference signal, the feedback control signal and the modifying value.

* * * * *